United States Patent [19]

Buckley et al.

[11] 3,978,775

[45] Sept. 7, 1976

[54] LINER INSERTION APPARATUS

[75] Inventors: Stephen P. Buckley, Kansas City, Mo.; Edward N. Patigalia, Potomac, Md.

[73] Assignee: The United States of America as represented by the Secretary of the Army, Washington, D.C.

[22] Filed: June 18, 1975

[21] Appl. No.: 588,090

[52] U.S. Cl. ..... 93/77 CL; 93/36.01; 93/81 R; 93/84 FF; 214/1 BE

[51] Int. Cl.[2] ..... B31C 5/00; B31B 1/12

[58] Field of Search ..... 93/36.01, 84 FF, 84 R, 93/77 CL, 81 R, 81 MT, 77 R, 39 C, 39.1 R, 54.1; 271/194, 195; 214/1 BE; 156/287

[56] References Cited

UNITED STATES PATENTS

| | | | |
|---|---|---|---|
| 1,993,751 | 3/1935 | Reid | 93/84 FF |
| 2,600,837 | 6/1952 | Boyer | 214/1 BE UX |
| 3,204,591 | 9/1965 | Pickett | 93/84 FF X |
| 3,237,536 | 3/1966 | Ristvedt et al. | 93/81 R |
| 3,736,655 | 6/1973 | Beckman | 93/81 R |
| 3,829,952 | 8/1974 | Trask | 93/81 R X |

*Primary Examiner*—James F. Coan

*Attorney, Agent, or Firm*—Nathan Edelberg; A. Victor Erkkila; Thomas R. Webb

[57] ABSTRACT

A liner of flexible sheet material is placed on a table on which a longitudinally-slotted cylindrical tube and a cylindrical container of slightly larger inner diameter are mounted in axial alignment, and the liner is started into the tube slot. The liner is drawn into the tube and formed into a coil therein by the force of a tangential air jet perpendicular to the slot. Then, the coiled liner is moved axially from the tube into the container by a second tangential air jet directed at an angle of about 45° to the axis. The resilience of the coiled liner causes it to spring outward to snugly fit within the container.

5 Claims, 3 Drawing Figures

LINER INSERTION APPARATUS

GOVERNMENTAL INTEREST

The invention described herein was made in the course of a contract with the Government and may be manufactured, used and licensed by or for the Government for governmental purposes without the payment to us of any royalty thereon.

BACKGROUND AND SUMMARY OF THE INVENTION

The present invention relates to an apparatus for coiling and inserting a liner made of flexible sheet material into a hollow cylindrical container, such as a canister for shipping and/or storing artillery ammunition. The liner serves as a packing material between the contents and the inner surface of the container.

This has heretofore usually been done manually, which is not only time-consuming but also becomes difficult with large size liners for large caliber ammunition.

In accordance with the invention, the liner is placed on a table and started into a longitudinally-slotted cylindrical tube open at one end and having an inner diameter slightly smaller than the inner diameter of the container to be lined. The liner is then moved into the tube and formed into a coil therein by a first tangential air jet perpendicular to the slot. After the liner is entirely within the tube, it is moved axially through the open end of the tube and into an axially-aligned container by a second tangential air jet directed at an angle of about 45° to the slot. The resilience of the liner causes it to spring outward slightly to snugly fit within the container. The liner may be fed into the slot either manually or automatically. The air jets may be started and stopped either manually or automatically. The first air jet may be either stopped or left on when the second air jet is started.

DETAILED DESCRIPTION OF A PREFERRED EMBODIMENT

Figure 1:
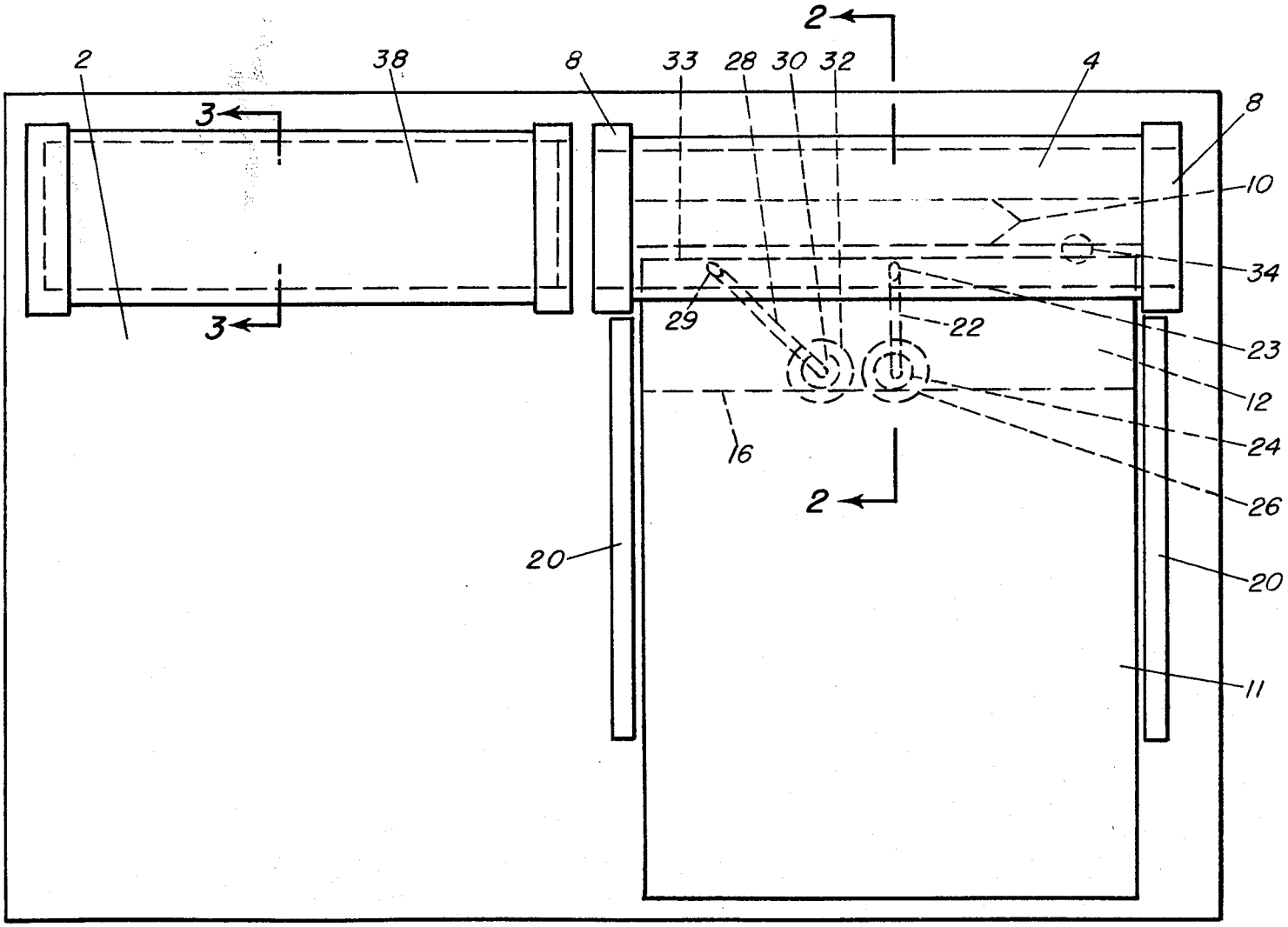
FIG. 1 is a top plan view of an apparatus constituting one embodiment of the invention.
Figure 2:
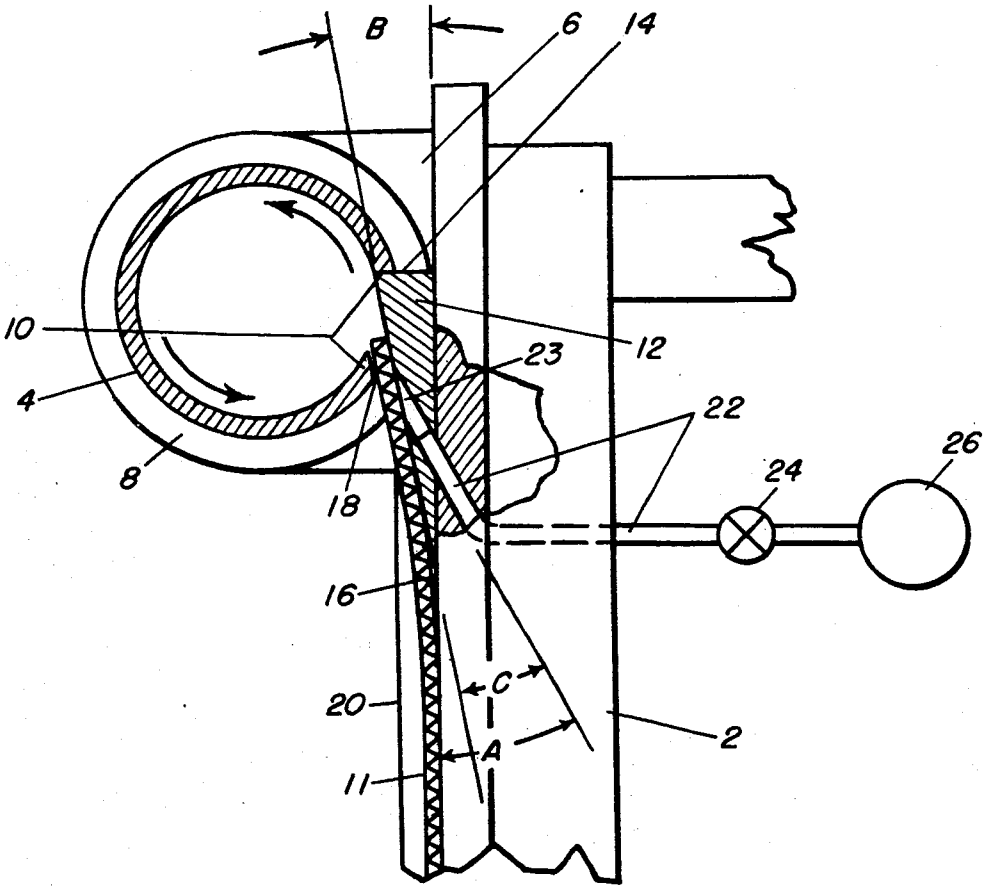
FIG. 2 is a transverse section view taken on the line 2—2 of FIG. 1.

FIGS. 1 and 2 show a table 2 on one side of which a cylindrical tube 4 is mounted by end brackets 6. Tube 4, which may have end flanges 8 as shown, is open at one end and formed with a narrow longitudinal slot 10 having a length slightly greater than the width of a liner 11 to be used and extending between the end flanges 8, as shown. The liner 11 may be a rectangular piece of corrugated paper board such as is used in making cardboard boxes, with the corrugations exposed on one side, as shown in FIG. 2. A wedge-shaped ramp 12, having a wedge angle B of 5° to 10°, is mounted on the table 2 with its thick edge 14 abutting one side of slot 10 and its knife edge 16 extending away from the slot (downward in FIGS. 1 and 2), leaving a narrow clearance slot 18 between the ramp and the other edge of slot 10 for the liner 11 to be inserted into the tube 4. Rails 20 may be provided on the table 2 for guiding the liner 11 into the tube 4.

A first tangential air jet is directed toward the side of the liner 11 facing the ramp 12, which side is preferably corrugated as shown in FIG. 2, by means of small-diameter tubing 22 which extends into a bore or channel 23 in the ramp 12 and the top of table 2 and is connected through a suitable control valve 24 to an air pressure source 26 (FIG. 2). Bore 23 is located midway between the ends of slot 10, is perpendicular to the slot 10, as shown in FIG. 1, and is inclined at an angle C of not more than 50°, and preferably 10° to 15° with respect to the upper surface of ramp 12, as shown in FIG. 2. In the example shown in FIG. 2, angle B is about 10°, angle C is about 10°, and the angle A with the table top is about 20°. A second tangential air jet is provided, at a point near but spaced from the left end of slot 10, by a small tubing 28, which extends into a second bore 29 in the ramp 12 and table 2, and is connected to a control valve 30 and air source 32. Bore 29 is inclined at an angle of about 45° to the slot 10, and may lie in the same plane as tubing 22.

Figure 3:
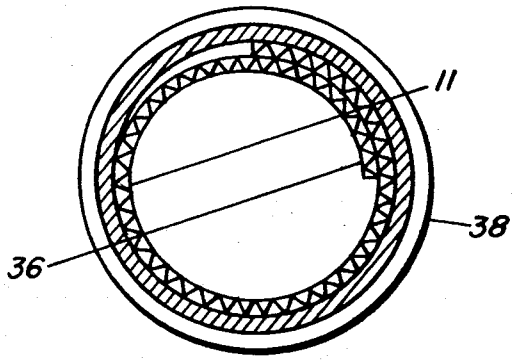
FIG. 3 is a transverse view, taken on line 3—3 of FIG. 1, of a container with a coiled liner therein.

The liner 11 may be placed on the table and fed to the tube 4 either by hand or by suitable automatic equipment. When the leading edge 33 of the liner 11 passes beyond the open end of bore 23, the valve 24 is operated to turn on the first tangential air jet. This may be done by hand or automatically by means of a sensor 34, located in the path of the liner just beyond the two air jets, and associated control means. The air jet engages the adjacent corrugated surface of the liner and forces the liner into the tube 4, forming a coil 36, for example of about 1¼ turns, as shown in FIG. 3.

The coil 36 is then moved axially into a hollow cylindrical container 38 supported on table 2 in axial alignment with tube 4. This may be accomplished as soon as the liner 11 is entirely within the tube 4, by turning on the second air jet from tubing 28. The axial component of the jet stream engaging the corrugated outer surface of the coil 36 moves the coil from the tube 4 into the container 38, while the tangential component of the jet stream continues the rotary motion of the coil. Thus, the first tangential jet from tubing 22 can be either turned off or left on. The usual resilience of the corrugated liner 11 causes th coil 36 to unwind and thus expand slightly, producing a snug fit of the coil 34 within the container 38, as shown in FIG. 3. This may be augmented by continuing the second jet for a while after the coil is transferred to blow air inside the liner to further expand the liner against the container wall.

In each of the coiling and transferring operations, the air jet provides an air film between the liner and the surrounding tube which reduces the frictional forces. The container 38 may be a conventional canister for storing or shipping artillery shells or propellant charges therefor.

What is claimed is:

1. Apparatus for coiling and inserting a liner of flexible sheet material having a rough surface on one side into a hollow cylindrical container, comprising:

a support surface;

a longitudinally-slotted tube open at one end and supported on said support surface with its slot at the bottom parallel to and spaced from said support surface;

a wedge-shaped ramp on said support surface, with its thick edge abutting one side edge of said slot and forming a smooth continuation of the liner wall of said tube, and its knife edge merging with said support surface; said ramp being spaced from the other side edge of said slot to leave a clearance slot for insertion of said liner;

means for propelling said liner, placed on said support surface and said ramp with its rough surface facing said ramp, through said slot and into said tube, and forming said liner into a coil, comprisng means for producing a first tangential air jet located midway between the ends of said slot and directed through said ramp and against said rough surface in a direction perpendicular to said slot; and means for inserting said coil into a hollow cylindrical container, supported adjacent to and in axial alignment with said tube, comprising means for producing a second tangential air jet located near the open end of said tube and directed through said ramp and against said round surface at an acute angle to said slot.

2. Apparatus as in claim 1, wherein the paths of said two air jets lie substantially in a common plane making an angle of not more than 50° with the upper surface of said ramp, and said acute angle is about 45°.

3. Apparatus as in claim 2, wherein the wedge angle of said ramp is 5° to 10° and said plane angle is 10° to 15°.

4. Apparatus as in claim 1, further comprising means including a sensor located in the path of said liner near just beyond the two air jets for automatically starting said first air jet.

5. Apparatus as in claim 1, wherein said support surface is the top of a table on which said tube, ramp and container are supported.

* * * * *